US011002084B2

(12) United States Patent
Pirazzini

(10) Patent No.: US 11,002,084 B2
(45) Date of Patent: May 11, 2021

(54) MANOEUVRING MEMBER

(71) Applicant: M.E.C. SRL Meccanica Alfonsine, Alfonsine (IT)

(72) Inventor: Roberto Pirazzini, Ravenna (IT)

(73) Assignee: M.E.C. SRL MECCANICA ALFONSINE, Alfonsine (IT)

( * ) Notice: Subject to any disclaimer, the term of this patent is extended or adjusted under 35 U.S.C. 154(b) by 252 days.

(21) Appl. No.: 15/750,298

(22) PCT Filed: Mar. 31, 2017

(86) PCT No.: PCT/IB2017/051849
§ 371 (c)(1),
(2) Date: Feb. 5, 2018

(87) PCT Pub. No.: WO2017/178918
PCT Pub. Date: Oct. 19, 2017

(65) Prior Publication Data

US 2018/0223605 A1 Aug. 9, 2018

(30) Foreign Application Priority Data

Apr. 11, 2016 (IT) ..... 102016000037151

(51) Int. Cl.
*E21B 17/046* (2006.01)
*E02D 11/00* (2006.01)

(52) U.S. Cl.
CPC ..... *E21B 17/046* (2013.01); *E21B 17/0465* (2020.05); *E02D 11/00* (2013.01)

(58) Field of Classification Search
CPC ..... E21B 17/046; E21B 17/0465; E02D 5/66; E02D 11/00; E02D 7/30
See application file for complete search history.

(56) References Cited

U.S. PATENT DOCUMENTS

2015/0136408 A1* 5/2015 Wright ..... F16L 37/086
166/344

* cited by examiner

*Primary Examiner* — George S Gray
(74) *Attorney, Agent, or Firm* — Abelman, Frayne & Schwab

(57) ABSTRACT

A maneuvering member for selectively attaching an actuating rotary member to a head portion of a drilling assembly. The maneuvering member includes a frame having an axial-symmetrical tubular portion internally delimited by a cylindrical mantle. The frame includes a first end that selectively interfaces with the actuating rotary member, and a second end provided with an alignment member for interfacing with a corresponding alignment member of the head portion of the drilling assembly. Hydraulically actuated blocking means is positioned at the second end and includes a pin that is actuated by a hydraulic fluid in a radially movable manner with respect to the frame at the second end. The pin is actuated between a back position in which the pin is arranged flush with the cylindrical mantle, and a forward position in which the pin projects inside the cylindrical mantel to selectively release/secure the head portion of the drilling assembly.

15 Claims, 4 Drawing Sheets

MANOEUVRING MEMBER

CROSS REFERENCE TO RELATED APPLICATIONS

This application is a national phase of PCT application No. PCT/IB2017/051849, filed Mar. 31, 2017, which claims priority to IT patent application No. 102016000037151, filed Apr. 11, 2016, all of which are incorporated herein by reference thereto.

The present invention relates to a manoeuvring member. In particular, the present invention relates to a manoeuvring member suitable for use with soil drilling machines. In more detail, the present invention relates to a manoeuvring member usable for equipping machines for making cylindrical holes in the soil for housing foundations piles.

BACKGROUND TO THE INVENTION

In the field of soil drilling for boring cylindrical holes for piles, the use is well known of machines equipped with a drilling unit provided with an axial-symmetrical drilling assembly. The drilling assembly is axially delimited by a casing shoe provided with a circular toothing in end position; through rotation, the toothing allows the casing shoe, and, more in general, the drilling assembly, to be put progressively deeper in the ground for boring the hole. The drilling units comprise a rotary actuator carried by a guide oriented according to the drilling direction, usually vertically, and an axial-symmetrical manoeuvring member interfacing the actuator with the drilling assembly, that may comprise only the casing shoe or also joining pipes for joining the casing shoe to the manoeuvring member, that are coaxially coupled to one another and to the casing shoe. It should be noted that drilling operations may be also performed by using machines by different manufacturers, each of which is provided with a drilling unit equipped with a coupling member manufactured according to non-standardized procedures, and therefore, in principle, different from one another. In particular, the manoeuvring members usually have a hollow tubular portion, used to house coaxially a rotary drilling tool, and are coupled to the respective actuator by means of a hinge coupling; namely, the manoeuvring members have, in a respective upper portion, two diameter holes housing a diameter axis that is centrally engaged by the drive shaft of the actuator, which drives the manoeuvring member, and therefore the drilling assembly connected thereto, into rotation. Usually, the manoeuvring members are manufactured without the upper portion, which is later welded to the tubular portion. It is easily to understand that this constructive solution is particularly onerous as regards times and costs necessary to adapt a manoeuvring member to the drilling unit to which it should be coupled, and, thus, it significantly limits the field of use thereof.

Moreover, the manoeuvring member and the drilling assembly are coupled by coupling at least one radial pin, carried in end position by the manoeuvring member, just above a respective free "female" edge, to a corresponding hole provided in a "male" portion provided at the top in the upper element of the drilling assembly. Obviously, each pin can centre the corresponding hole thanks to the presence of centering members at the interface between the upper element of the drilling assembly that ensure that the coupling is coaxial and the angular reference is correct.

Each pin is carried by a cylindrical support and is actuated between a blocking position and a releasing position of the corresponding hole of the "male" portion of the upper element of the drilling assembly, thus causing a radial movement forward, in a helix-like manner, through a lever transverse to the rotation axis of the pin. In this way, each pin is so controlled as to engage or release radially the upper element of the drilling assembly and to drive it into rotation with the actuator or to free it, leaving it ready for the elongation or the disassembly, once the drilling depth has been achieved.

The coupling pins are usually four at 90°, and it is easily understood that the operations for coupling the pins to and releasing them from the drilling assembly require the operator to be in front of each pin and to actuate the respective lever both to couple the manoeuvring member to, and to release it from, the drilling assembly.

In view of the above description it would be desirable to have available a manoeuvring member that, in addition to allow limiting and possibly overcoming the drawbacks of the prior art, defines a new standard for the use of soil drilling tools.

SUMMARY OF THE PRESENT INVENTION

The present invention relates to a manoeuvring member. In particular, the present invention relates to a manoeuvring member usable for equipping soil drilling machines.

In more detail, the present invention relates to a manoeuvring member usable for equipping machines for making cylindrical holes in the soil for housing foundations piles.

The object of the present invention is to provide a manoeuvring member that can be easily prepared, has limited cost and is practical to be used.

According to the present invention a manoeuvring member is provided, whose main features will be described in at least one of the appended claims.

BRIEF DESCRIPTION OF DRAWINGS

Further characteristics and advantages of the manoeuvring member of the invention will be more apparent from the description below, set forth with reference to the attached drawings which illustrate at least one non-limiting embodiment, and where identical or corresponding parts of the member are identified by the same reference numbers. In particular.

DETAILED DESCRIPTION OF THE PRESENT INVENTION

Figure 2:
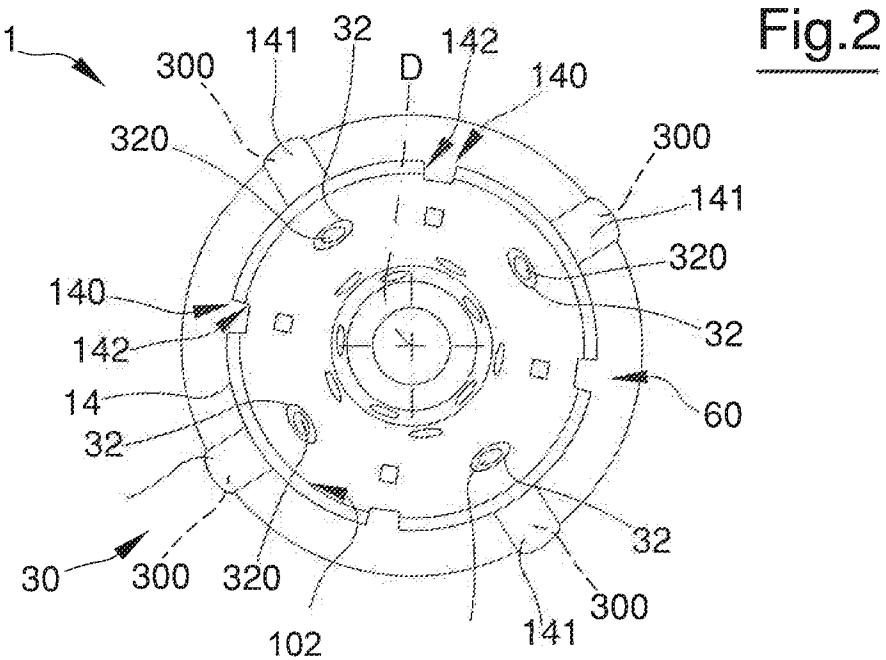
FIG. 2 is a view from the bottom of FIG. 1 in reduced scale.
Figure 1:
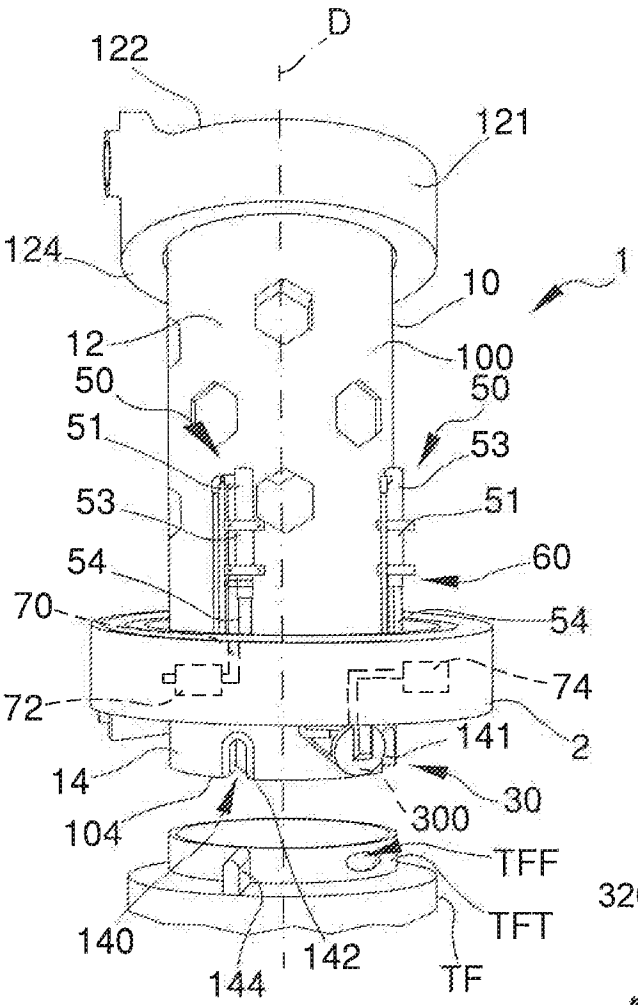
FIG. 1 is a schematic perspective view of a manoeuvring member according to the present invention.

In FIGS. 1 and 2, a manoeuvring member 1 comprising a frame 10 having an axial-symmetrical tubular portion 100 internally delimited by an inner cylindrical mantel 102 (FIG. 2) extending in a given direction D is illustratively shown. The frame 10 is provided with a first end 12 delimiting the tubular portion 100 at the top and able to interface with a well-known actuating rotary member, which is not a part of the claimed invention and is omitted from the drawings for the sake of practicality. The frame 10 is also provided with a second female end 14 delimiting the tubular portion 100 at the bottom. With particular reference to FIG. 2, the second end 14 is provided with keyed coupling members 140 so shaped as to couple, in a bayonet-like way, to a head portion TFT of a drilling assembly TF, that is known and therefore shown only partially for the sake of drawing economy and because it does not fall within the scope of the present invention. The second end 14 comprises a blocking device 30 that selectively couples with the drilling assembly TF. The blocking device 30 comprises at least one coupling pin 32 (see e.g., FIG. 2A) carried by the second end 14 in a radially movable way between a back position P1 (FIG. 11), where an end 320 of the pin 32 is arranged flush with the cylindrical mantle 102, and a forward position P2 (FIG. 12), where the end 320 of the pin 32 passes through the sidewall of the tubular portion 100 and projects inside the cylindrical mantel 102 in order to engage radially a cylindrical hole TFF (FIG. 11) provided radially in the head portion TFT. The blocking device 30 is hydraulically actuated, as is described below in further detail.

Figure 3:
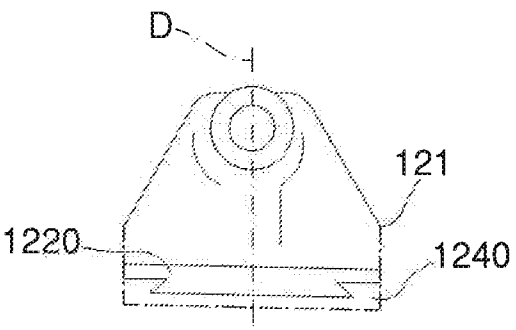
FIG. 3 is a side elevational view of a detail of FIG. 1.

With particular reference to FIGS. 1 and 3, the first end 12 can be composed and is provided with a plate 122, that delimits at the bottom a coupling portion 121 of the manoeuvring member 1, and with a flange 124, that delimits at the top the tubular portion 100; the plate 122 and the flange 124 are connected together in a releasable and selectively fixed way, prismatically transversely to the given direction D, by means of respective first element 1220 and second element 1240, dovetail-shaped in conjugated manner.

With reference to FIG. 1, the coupling members 140 comprise at least one concave portion 142 provided in a lower edge 104 of the second end 14, in order to align with and define an abutment for a corresponding projection 144 associated with the head portion TFT. The edge 104 can have a plurality of concave portions 142 which are spaced-apart at a predetermined angular distance. In some cases, it may be useful to arrange each pin 32 between adjacent keyed pairs of projections 144 and a concave portions 142.

The manoeuvring member 1 comprises an actuating group 60 carried by the tubular portion 100 and provided with a hydraulic circuit 62 (FIGS. 10-13) provided with a first duct 70 and a second duct 90.

Figure 4:
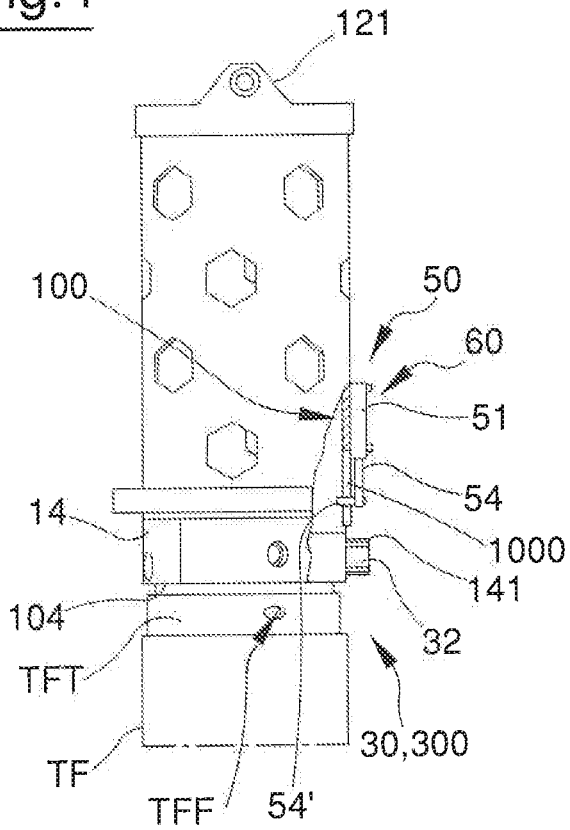
FIG. 4 is a schematic side elevational view in reduced scale of FIG. 1, in operative conditions.

With reference to FIG. 4 and to FIGS. 6-9, the tubular portion 100 has a slot 1000 arranged at greater height with respect to the edge 104; the slot 1000 extends axially and has given longitudinal extension; the actuating group 60 comprises a detection device 50 carried by the tubular portion 100 and comprising at least one first linear actuator 51. The first linear actuator 51 is arranged parallel to the given direction D, and is provided with a first stem 54 axially delimited by a radial end 54' engaging the slot 1000 radially and extending in order to match, in use, with the head portion TFT.

Figure 7:
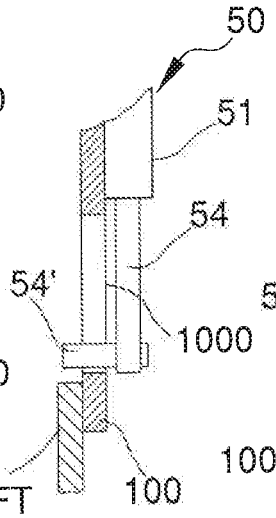

In particular, each detection device 50 comprises a first linear actuator 51, where each first linear actuator 51 can be equally single-acting or double-acting without affecting the protective scope of the invention. Each first linear actuator 51 is arranged parallel to the given direction D and comprises a first stem 54 axially delimited by the radial end 54' which is provided to detect a lower end of the slot 1000, as shown in FIG. 7.

Figure 2A:
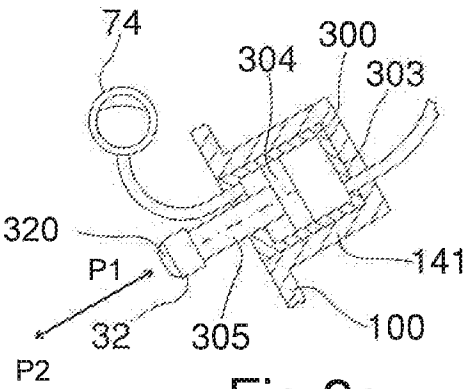
FIG. 2A is a cross-sectional view of an actuator of the manoeuvring member of FIG. 1.
Figure 6:
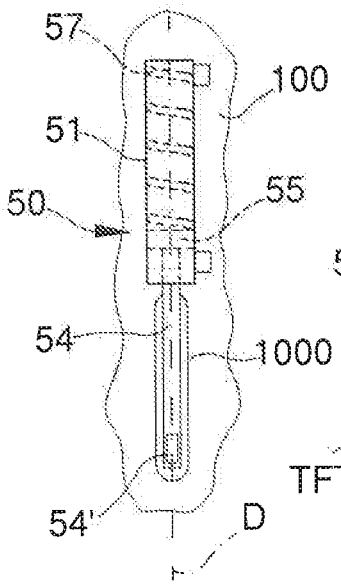
FIGS. 6 and 7 are enlarged views of a detail extracted from FIG. 4 in a first operating configuration.
Figure 8:
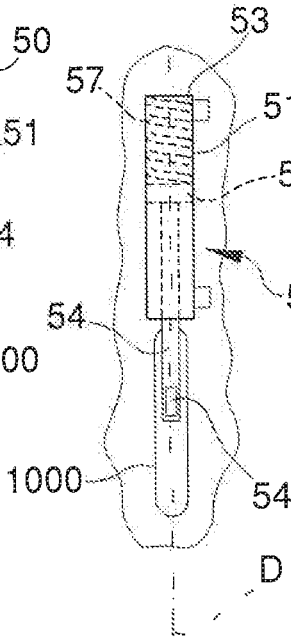
FIGS. 8 and 9 are enlarged views of a detail extracted from FIG. 4 in a second operating configuration.
Figure 9:
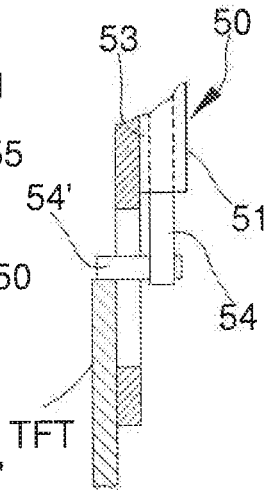
Figure 10:
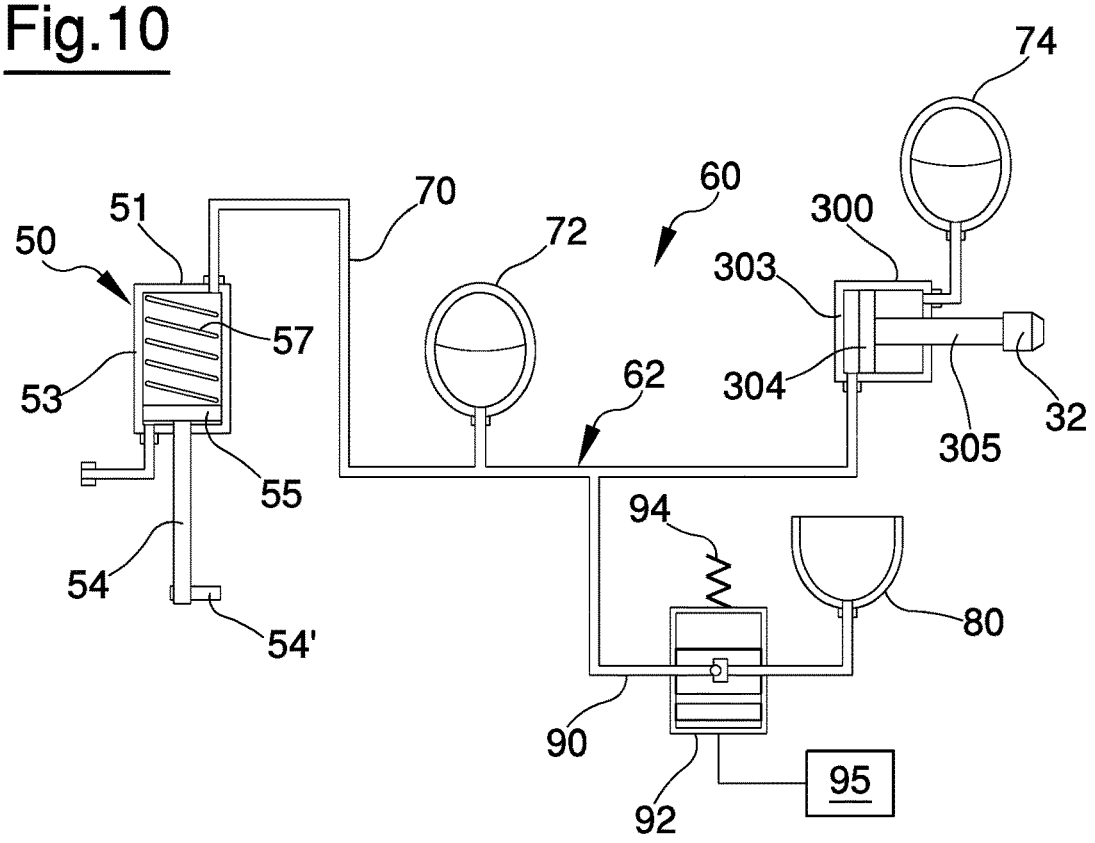
FIG. 10 is a diagram of a hydraulic circuit according to the invention.

With reference to FIGS. 2 and 2A, the blocking device 30 comprises, for each pin 32, a double-acting second linear actuator 300 carried by the cylindrical portion 100 inside a cylindrical support 141 arranged outside. Each second actuator 300 is radially supported by the tubular portion 100 and is provided with a second case 303, inside which a second piston 304 is housed that is rigidly carrying a second stem 305, which is axially delimited by the pin 32, as shown in FIG. 2A. Referring now to FIGS. 10-13, the first actuator 51 is provided with a first case 53 hydraulically coupled to the second case 303 of the second actuator 300 through the first duct 70, illustrated only in FIGS. 10-13 for the sake of practicality. With reference to FIGS. 6 and 8, the first actuator 51 also comprises a first piston 55 and a first spring 57, which are contained inside the first case 53. The piston 55 is affixed to one end of the first stem 54, which has an opposing end extending from the case 53.

With reference to the diagrams of FIGS. 10-13, the actuating group 60 comprises a first hydraulic accumulator 72 that, as it is schematically shown in FIG. 1, is carried by the second end 14 of the tubular portion 100 and is hydraulically coupled to the first duct 70 in intermediate position between the first actuator 51 and the second actuator 300 in order to act as a hydraulic reserve for the actuating group 60. The actuating group 60 comprises a second hydraulic accumulator 74 hydraulically coupled to the second case 303 of the second actuator 300 in order to act as a hydraulic reserve for the second actuator 300 at the side of the respective second stem 305.

The actuating group 60 also comprises a tank 80. The second duct 90 is designed to connect hydraulically the tank 80 to the first duct 70 in intermediate position between the first accumulator 72 and the second actuator 300; a slide valve 92 is associated with the second duct 90; the valve is arranged between the tank 80 and the first duct 70 (FIG. 5 and FIGS. 10-13). The slide valve 92 is a two-position normally-closed (NC) valve so designed as to be suitable in use to prevent the flow towards the tank 80 and, alternatively, to be opened against the thrust of a spring 94, as shown in FIGS. 10-13.

Figure 5:
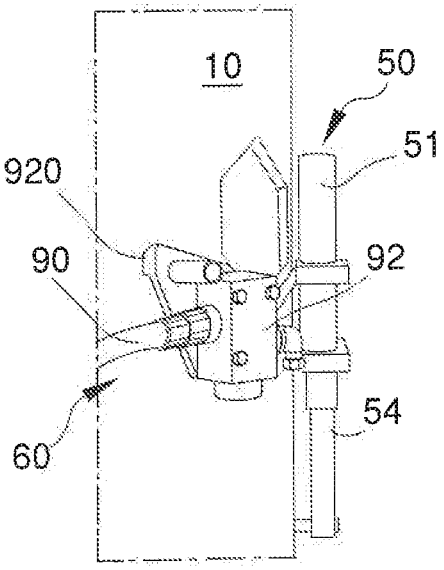
FIG. 5 is a view in enlarged scale of a detail of FIG. 1.

The slide valve 92 can be manually or electronically switched. In particular, the slide valve 92 can include a switching lever 920 which can be actuated against the thrust of the spring 94, or it may be provided with inner switching members, known and not shown, that can be electronically actuated. In this case, the actuating group 60 comprises an electronic control unit 95 in order to switch the slide valve 92 remotely against the thrust of the spring 94. For the sake of practicality, both the lever 920 actuating the slide valve 92 and the control unit 95 are shown in FIG. 5.

Figure 11:
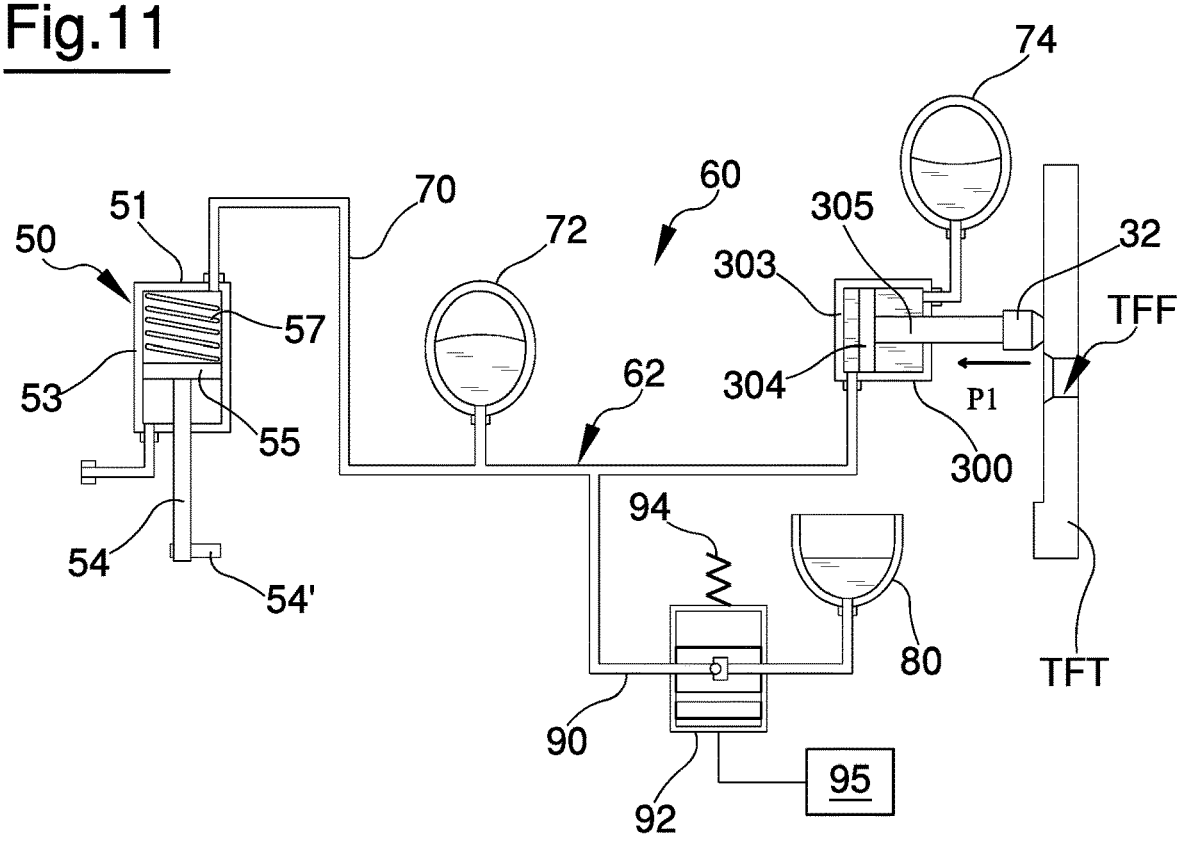
FIGS. 11-13 show the diagram of FIG. 10 in three operating configurations.
Figure 12:
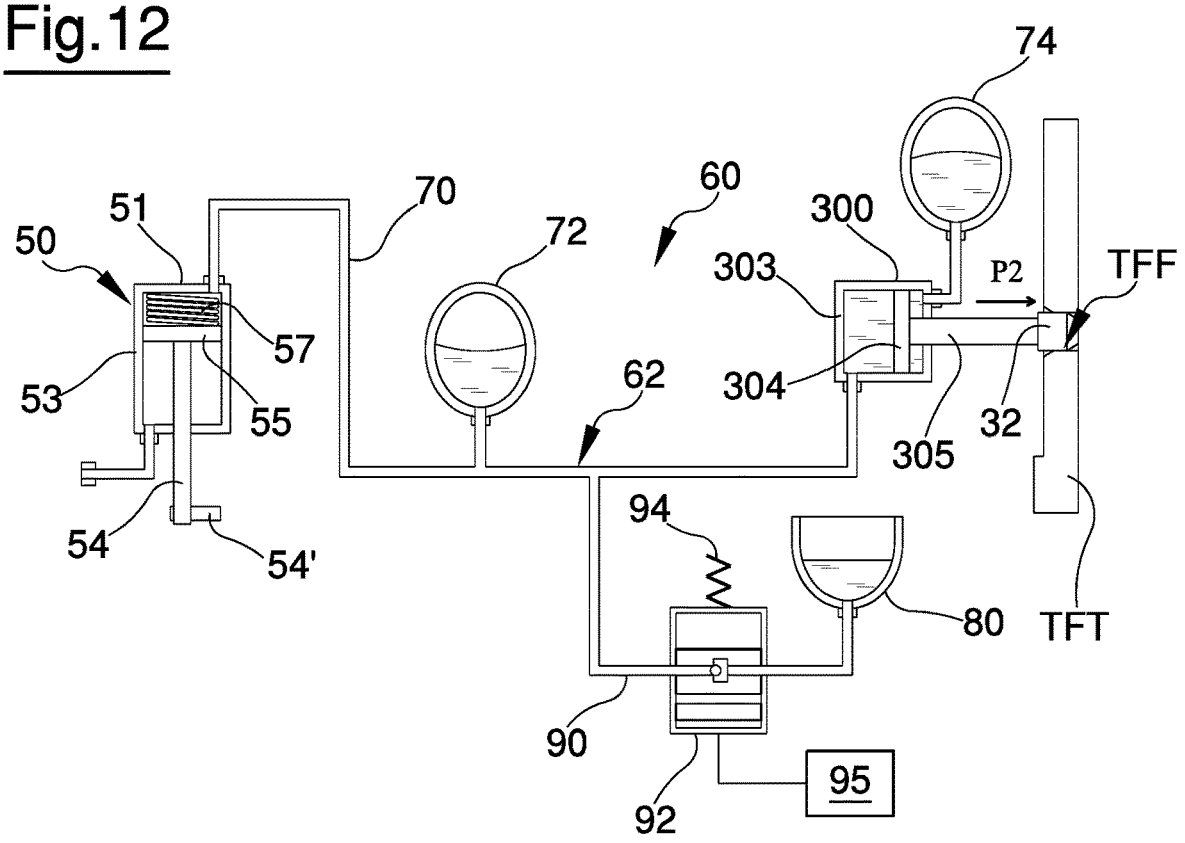
Figure 13:
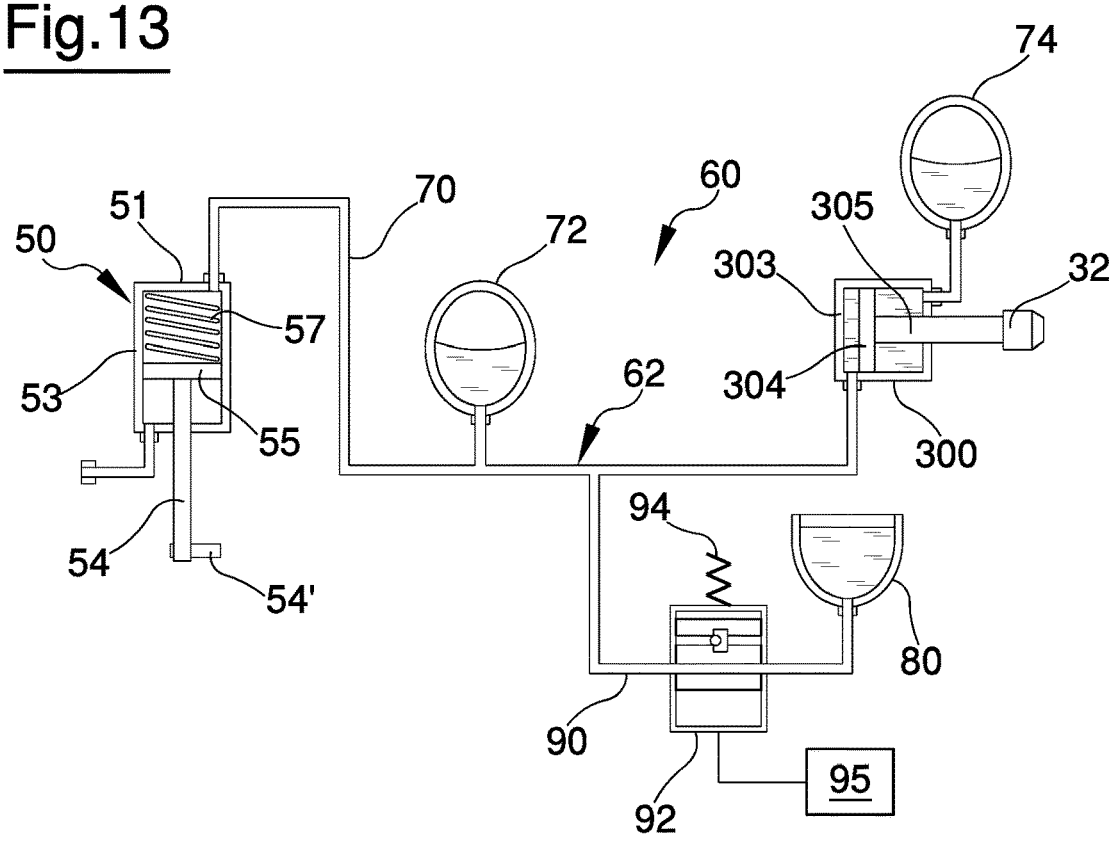

The operation of the manoeuvring member 1 is clearly apparent from the description above and does not require further explanations. However, it should be useful to specify that through the manoeuvring member 1 it is possible to implement an operation method that does not require, in ordinary operation, the manual intervention of operators in order to couple the manoeuvring member 1 and the drilling assembly TF. In particular, the method that can be implemented according to the present invention comprises the steps of putting the second portion 14 into coupling position with the head portion TFT of a drilling assembly TF, so that the respective abutments 144 engage the concave portions 142 of the second end 14. This step is followed by a step of leaving the valve 92 in closing position and of lowering the frame 10 in order to push the first stem 54 inside the first case 53, against the thrust of the first spring 57 that is thus compressed. In this way a step may be determined of moving the pin 32 from the back position P1 to the forward position P2. Moreover, with reference to FIG. 11, the step of moving the pin 32 from the back position P1 depends on a condition of free movement of the same pin 32, and therefore depends on the fact that each pin 32 faces a corresponding hole TFF in of the head portion TFT of the drilling assembly TF. In this way, the male-female coupling between the head portion TFT (male, see FIG. 1) and the second end 14 (female, see FIG. 1), delimiting at the bottom the tubular portion 100, has been completed. The condition of the actuating group 60 shown in FIG. 12 corresponds to this situation. Obviously, when the movement of the pin 32 from the back position P1 is not yet possible, the pressure inside the first accumulator 72 increases. As it is easily understood, and is shown in FIG. 11, the step of moving the pin 32 is accompanied by a step wherein the pressure inside the first accumulator 72 decreases and the pressure inside the second accumulator 74 increases, due to the confluence of the liquid contained in the second case 303 at the side of the second stem 305 in the second accumulator 74.

The opening of the slide valve 92 performed manually through the lever 920 or electronically through the control unit 95 (FIG. 13) hydraulically connects the tank 80 to the first duct 70, so that the pressure inside the accumulator 74, which is higher than the pressure inside the first accumulator 72, forces the pin to move backward, thus entering again inside the tubular portion 100 of the manoeuvring member 1.

It should be noted that in FIGS. 1 and 2 the manoeuvring member 1 is provided with a cylindrical protection 2, coaxial with the tubular portion 100 and covering longitudinally the second female end 14 thereof, therefore the components of the blocking group and of the actuating group 60 arranged outside the tubular portion 100. Lastly, it is clearly apparent that variants and modifications can be done to the manoeuvring member 1 described and illustrated herein without however departing from the protective scope of the invention.

For instance, it is clearly apparent that, even if in FIGS. 10-13 an actuating group 60 has been shown provided with only one detection device 50 and only one pin 32, the hydraulic diagram of the actuating group 60 can be replicated in order to control the four pins 32 shown in FIG. 2.

In view of the above description it is clearly understood that the manoeuvring member 1 allows to solve the problem of remotely actuating each pin 32 with respect to the cylindrical support 141 thereof through the control unit 95 in order to be alternatively positioned in the back position P1, where the pin 32 is outside the mantle 100, the inner space of the tubular portion 100 is axially completely free; the coupling between the male part of the head portion TFT and the female second end 14 delimiting at the bottom the tubular portion 100 is therefore possible; additionally the pin 32 in the forward position P2 can engage the space inside the mantle 100 in a simple and safe manner. Moreover, the presence of the lever 920 makes the manoeuvring member 1 operable also in case electricity is not supplied to the control unit 95.

The invention claimed is:

1. A maneuvering member for selectively attaching an actuating rotary member to a head portion of a drilling assembly, the maneuvering member comprising:

a frame having an axial-symmetrical tubular portion internally delimited by a cylindrical mantle extending in a predetermined direction; said frame including a first end configured to interface with the actuating rotary member, and a second end provided with a keyed coupling member which selectively interfaces with an opposing keyed coupling member associated with the head portion of the drilling assembly; and hydraulically actuated blocking means positioned at said second end and including at least one pin that is actuated by a hydraulic fluid in a radially movable manner with respect to the frame by said second end, said at least one pin being actuated between a back position in which said at least one pin is arranged flush with said cylindrical mantle, and a forward position in which said at least one pin projects inside said cylindrical mantel.

2. The maneuvering member according to claim 1, wherein the hydraulically actuated blocking means actuates the at least one pin in an extended locking position upon the second end of the frame being aligned in a keyed arrangement with and contacting the head portion of the drilling assembly.

3. The maneuvering member according to claim 1, wherein said blocking means comprises hydraulic actuating means.

4. The maneuvering member according to claim 3, wherein said first end is modular and provided with a plate and with a flange delimiting said tubular portion at the top; said plate and said flange being connected together in a releasable and selectively fixed manner transversely to said predetermined direction.

5. The maneuvering member according to claim 4, wherein said plate and said flange are connected together in a releasable manner by means of respective first element and second element that are dovetail-shaped in conjugated manner.

6. The maneuvering member according to claim 3, wherein said coupling member comprise at least one projection and at least one concave portion provided in an edge of said tubular portion and arranged at a predetermined angular distance so as to define abutments for a coupling.

7. The maneuvering member according to claim 6, wherein said tubular portion has a slot arranged at a greater height with respect to said edge of the tubular portion; said slot extending axially and having a predetermined longitudinal length; said hydraulic actuating means comprising a detection device carried by said tubular portion and having a first linear actuator associated with said slot; wherein said first linear actuator is arranged parallel to said predetermined direction and provided with a first stem axially delimited by a radial end, said radial end being configured and extending radially through said slot and a predetermined distance from the first stem to selectively engage, in use, with the head portion of the drilling assembly.

8. The maneuvering member according to claim 7, wherein said blocking means comprises a second linear actuator for each said pin; each said second actuator being radially supported by said tubular portion and provided with a second case containing a second piston rigidly connected to a second stem, which is axially delimited by said pin.

9. The maneuvering member according to claim 8, wherein said second linear actuator is a double-acting actuator; said first linear actuator being provided with a first case hydraulically connected with said second case through a first duct; said first linear actuator furthermore comprising a first piston and a first spring contained inside said first case at opposite side with respect to said first stem.

10. The maneuvering member according to claim 9, wherein said hydraulic actuating means comprises a first hydraulic accumulator hydraulically connected with said first duct between said first linear actuator and said second linear actuator so as to act as a hydraulic reserve; a second hydraulic accumulator being hydraulically connected with said second case of said second actuator so as to act as a hydraulic reserve for said second actuator at the side of the second stem.

11. The maneuvering member according to claim 10, wherein said hydraulic actuating means comprises a second duct and a tank; said second duct being arranged to connect hydraulically said tank to said first duct in an intermediate position between said first accumulator and said second linear actuator; a valve being associated with said second duct, the valve being arranged between said tank and said first duct.

12. The maneuvering member according to claim 11, wherein said valve, in a closed state, prevents hydraulic fluid flow towards said tank and, alternatively in an opened state, against thrust forces of a spring.

13. The maneuvering member according to claim 12, wherein said valve comprises a switching lever that is actuated against the thrust of said spring.

14. The maneuvering member according to claim 12, wherein said valve is electronically switched; said hydraulic actuating means comprising an electronic control unit to switch said valve remotely against the thrust of said spring.

15. The maneuvering member according to claim 7, wherein the head portion of a drilling assembly causes longitudinal movement of the first stem to trigger the hydraulic actuating means which causes outwardly movement of the at least one pin.

* * * * *